US005757387A

United States Patent [19]

Manduley

[11] Patent Number: 5,757,387

[45] Date of Patent: May 26, 1998

[54] PRINT HEAD CLEANING AND INK DRYING APPARATUS FOR MAILING MACHINE

[75] Inventor: Flavio M. Manduley, Woodbury, Conn.

[73] Assignee: Pitney Bowes Inc., Stamford, Conn.

[21] Appl. No.: 354,569

[22] Filed: Dec. 12, 1994

[51] Int. Cl.[6] ..... B41J 2/165

[52] U.S. Cl. ..... 347/2; 347/23; 347/33; 347/102

[58] Field of Search ..... 347/2, 3, 4, 22, 347/23, 33, 101, 102, 104

[56] References Cited

U.S. PATENT DOCUMENTS

| | | | |
|---|---|---|---|
| 4,340,897 | 7/1982 | Miller | 346/140 |
| 4,369,456 | 1/1983 | Cruz-Uribe et al. | 346/140 R |
| 4,959,529 | 9/1990 | Matsumoto et al. | 219/388 |
| 4,994,642 | 2/1991 | Matsumoto et al. | 219/388 |
| 5,189,442 | 2/1993 | Herbert | 347/2 |
| 5,214,442 | 5/1993 | Roller | 346/1.1 |
| 5,467,709 | 11/1995 | Salomon | 347/4 |

FOREIGN PATENT DOCUMENTS

| | | | |
|---|---|---|---|
| 60-31970 | 2/1985 | Japan | 347/33 |
| 2-162045 | 6/1990 | Japan | 347/101 |
| 5-64895 | 3/1993 | Japan | 347/33 |
| 5-42677 | 5/1993 | Japan | 347/33 |

*Primary Examiner*—John E. Barlow, Jr.

*Attorney, Agent, or Firm*—Steven J. Shapiro; Melvin J. Scolnick; David E. Pitchenik

[57] ABSTRACT

An apparatus for cleaning the nozzle plate of an ink jet print head and for drying the ink of an indicia on an envelope just printed is disclosed in which a strip of absorbent material is drawn across the nozzle plate after each or a predetermined number of printing operations has been completed, and heat is applied to the area of the absorbent material passing across the nozzle plate so that the absorbent material cleans any ink or other debris which may have collected on the nozzle plate during the printing operation. A similar strip of absorbent material is pressed against a freshly printed indicia on each succeeding envelope, and heat is applied to the area of the absorbent material that is in contact with the indicia to facilitate drying of the ink and to cause the absorbent material to absorb any excess ink on the indicia.

12 Claims, 4 Drawing Sheets

PRINT HEAD CLEANING AND INK DRYING APPARATUS FOR MAILING MACHINE

BACKGROUND OF THE INVENTION

The present invention relates generally to the field of ink jet printing, and more particularly to an apparatus for periodically cleaning the print head of an ink jet printer and ensuring that the ink image just printed by the printer on a receiving medium is thoroughly dry.

The technology of ink jet printing has become well known and printers of many sizes and configurations have become commonplace in various printing applications. This technology provides a relatively simple form of printing apparatus which yields rapid and substantially high quality print for the extent of the complexity of the printing apparatus involved. These qualities render ink jet printing technology and apparatus based thereon highly suitable for a variety of printing applications, particularly computer desk top publishing, graphic plotters and textile printing.

In order to better understand the problems which are solved by the present invention, it is necessary to have a basic familiarity with the principles of ink jet printing, and how the print head works. Although there are several types of ink jet printers in general use, for the purpose of illustration the principles of ink jet printing will be explained in connection with the type of ink jet printer in which the present invention is intended for use, it being understood, however, that the present invention is applicable to any of the other types of ink jet printers.

Generally speaking, ink jet printing involves the use of a print head having an array of very small nozzles arranged on a nozzle plate in very closely spaced relationship and spanning the distance over which a line of print is to appear on paper. The print head includes a reservoir of ink which communicates through individual conduits with a plurality of very small chambers, one for each nozzle, through which the ink flows to reach the nozzles. Each chamber contains a small, high energy resistance heating element which is responsive to a minute electrical current to heat almost instantly to a sufficiently high temperature to volatilize the solvent in the ink and thereby create a small bubble in the ink adjacent the heating element. The momentary increase in hydrostatic pressure in the ink within the chamber resulting from creation of the bubble is sufficient to force a small amount of ink from the nozzle connected to the chamber, and a tiny droplet of ink is deposited on the paper adjacent to the nozzle. The actual printing of any form of text or graphic material on a piece of paper is the result of extremely rapid control over the plurality of heating elements in a predetermined sequence under the control of suitable software, combined with relative movement between the paper and the print head, to deposit droplets of ink in a pattern which will yield the desired image.

A significant problem that arises with this type of printing apparatus is that the ink tends to dry on the print head immediately adjacent to and even very slightly within the nozzles on the print head. It should be kept in mind throughout this description that the ink jet nozzles are extremely small, typically in the order of 50 microns or less in diameter and spaced about 3 mils apart, with the result that very little drying effect on the ink is required to obstruct a nozzle to the point where it cannot deposit a droplet of ink, either at all or not in the desired place on the paper, in response to operation of the heater. The reason is that the hydrostatic pressure created in the chamber by energization of the heater is very small, thereby requiring an entirely unobstructed nozzle in order for the device to operate properly. Obviously, any malfunction of the nozzles, even one, has a deleterious effect on the print quality derived from the print head.

Another problem inherent in ink jet printing devices, somewhat related to that described above, is that of maintaining the nozzle plate of the print head as clean and free from any form of debris as possible. Due to the extremely small size of the nozzles and the close spacing therebetween as described above, it is apparent that even microscopically small particles of dust can at least partially, if not entirely, obstruct the opening of a nozzle sufficiently to prevent the flow of ink therefrom when the associated heater is activated.

Several attempts to solve these problems have been made and various devices have been developed to counteract the effects of dried ink in or adjacent to the nozzles, as well as debris collecting on the nozzle plate adjacent to the nozzles, and many of these devices having met with some degree of success. Typically, prior art solutions have centered around providing a combination of wipers which wipe across the nozzle plate of the print head periodically, either during a printing operation or when it is completed, thereby removing dust and other debris which might otherwise clog the nozzles. Also, caps have been provided which cover the nozzle plate during periods of non-printing and a solution of ink or ink solvent is periodically injected into the cap to maintain a high ink solvent level at the nozzle plate to prevent ink in or immediately adjacent to the nozzles from drying out. In typical prior art solutions, however, the wipers are mounted separately from the cap, thereby requiring additional structure to achieve an effective wiping operation. Also, the quantity of ink or solvent that is injected into the cap with each operation of the pump is very small and therefore maintains a high solvent vapor level for only a relatively short period of time. Still further, the pump that injects the ink or solvent into the cap periodically will not operate unless the machine of which the ink jet printer is a component is connected to a suitable source of power. Thus, it has been found, that the prior art solutions have not been adequate to deal with the foregoing problems in the particular printing application for which the present invention is used, that is, a postage indicia which is printed by the postage meter component of a mailing machine on an envelope to evidence the payment of postage.

In most printing applications, particularly those involving the examples given above, it can readily be appreciated that if a printing operation is commenced and it becomes apparent that there is a problem with the ink jet printer that is causing unacceptable print quality, the printed material can be disposed of and the printing operation restarted after appropriate servicing of the print head, usually without the loss of any money.

The situation is entirely different, however, with mailing machines in which the postage meter component is, in effect, printing money. Therefore, the United States Postal Service imposes very stringent requirements on the print quality of the postage indicia printed by the postage meter. Obviously, if a postage meter prints an indicia on an envelope which is partially or entirely illegible, it will not be accepted for mailing and must be reprinted. In high speed mailing machines, many such envelopes could be printed before the unacceptable print quality is realized, which then must be discarded and reprinted, thereby resulting in the loss of a considerable amount of money, both from the wasted postage and from the down time of the mailing machine while it is being serviced. Thus, it becomes commercially critical for a postage meter to print an acceptable postage indicia each time it is operated, including the first time.

This introduces another problem which is frequently encountered with mailing machines. It is not uncommon in certain situations for a mailing machine to sit idle for lengthy periods of time, particularly in the case of small businesses or home users who may only use their mailing machines once or a few times a month, for example, in connection with paying bills, and this affords ample time for ink to dry in or adjacent to the nozzles. Other factors can contribute to the possibility of ink volatilizing in or adjacent to the nozzles and therefore interfering with the proper discharge of ink, such as mailing machines being stored for some time in a hot warehouse after they leave the factory, or being used in non-office environments such as the hot warehouse just mentioned or in an area of continuously maintained low vapor atmosphere. These and other situations can cause ink in or adjacent to the nozzles to dry out and prevent proper operation of the printer.

Thus, despite the fact that some prior art sealing caps will function to prevent the ink from drying out in the print heads of various types of ink jet printers for a limited period of time, or alternatively require relatively complex and costly apparatus to maintain a fresh supply of ink or solvent to prevent ink from drying in or adjacent to the nozzles, it has been found that these devices are ineffective to solve the more unique problems associated with ink jet printers in mailing machines, and that a more effective solution is required.

A still further problem that is encountered in connection with the printing of postage indicia on envelopes is that when multiple envelopes are fed through the mailing machine in fairly rapid succession, there is a possibility that the ink on one envelope is not thoroughly dry before a succeeding envelope is ejected from the mailing machine and is deposited on the first envelope, which may result in the ink on the first envelope being smudged, thereby rendering the quality of the postage indicia unacceptable according to U.S.P.S. standards. This situation is even more likely in the case of high volume mailing machines through which envelopes are fed at a rapid rate and are stacked in an automatic stacking device. Thus, depending on the speed of operation of the mailing machine, the degree of absorbancy of the paper from which the envelopes are made and on which the indicia is being printed, and the evaporation rate of the volatile solvents in the ink, it is possible that the ink will not dry sufficiently in the brief interval between successive envelopes to prevent a certain degree of smudging of the indicia on a large number of successively printed envelopes. It should be apparent that in high volume mailing applications, this situation would be entirely unacceptable from the standpoint of lost money from the printing of large numbers of envelopes having unacceptable indicia thereon.

It is thus apparent that there is a need for more effective ways of rapidly cleaning the nozzle plates of ink jet printing devices, both during printing operations and after completion thereof, and of rapidly drying the ink on each image receiving medium, particularly in the case of printing postage indicia on envelopes.

SUMMARY OF THE INVENTION

The foregoing disadvantages and problems of prior art ink jet printing apparatus are largely alleviated if not eliminated by the present invention which combines both a nozzle plate cleaning function and an ink drying function in the same ink jet printing apparatus. By combining relatively similar components in two separate devices it is now possible to periodically clean the nozzle plate of an ink jet printing device while the printing device is in operation to print an image on successive envelopes moving past the printing device and simultaneously to thoroughly dry the ink on each successive envelope as it is about to exit from the mailing machine.

In its broader aspects, the present invention resides in a mailing machine having a feed deck along which envelopes are adapted to be fed seriatim for having a postage indicia printed thereon, a feeding means for feeding the envelopes along the feed deck, and an ink jet print head disposed in overlying relationship to the feed deck, the print head including a nozzle plate disposed closely adjacent to the feed deck and means for periodically ejecting ink through apertures in the nozzle plate. In this environment, the present invention is a print head cleaning and ink drying apparatus for the mailing machine, which comprises a cleaning means disposed adjacent the print head in spaced relationship with the nozzle plate but on the opposite side of the feed deck from the print head for periodically cleaning the nozzle plate. There is a drying means disposed adjacent the print head in spaced relationship with the feed deck but on the same side of the feed deck as the print head for drying the ink on the envelopes as they are moved along the feed deck beyond the print head. There is also a control means for coordinating the operation of the cleaning means and the drying means with the movement of the envelopes along the feed deck to cause the cleaning means to clean the nozzle plate after each or a predetermined plurality of envelopes have moved past the print head, and to cause the drying means to dry the ink on the envelopes as each envelope passes under the drying means, whereby the cleaning means cleans the nozzle plate periodically during operation of the mailing machine and also dries the ink on the envelopes after each postage indicia printing operation of the mailing machine.

In some of its more limited aspects, the cleaning means comprises an ink absorbent material which is moved toward and away from the nozzle plate and also laterally relative to the nozzle plate, and there is a heating element associated with the device for moving the absorbent material so that it is heated as it wipes across the nozzle plate. The drying means also includes an ink absorbent material that is moved toward and away from the feed deck as well as laterally relative to the feed deck, but at the same speed as an envelope passing under the drying means so that there is no relative movement between the absorbent material and the printed indicia on the envelope. Also, a heating element is associated with the device for moving the absorbent material toward and away from the feed deck so that the absorbent material is heated while it is in contact with the postage indicia.

Having briefly described the general nature of the present invention, it is a principal object thereof to provide a print head cleaning and ink drying apparatus for a mailing machine in which the nozzle plate of the ink jet print head is cleaned after each printing operation or after a predetermined plurality of printing operations, and the ink is dried on the envelopes after each printing operation.

It is another object of the present invention to provide a print head cleaning and ink drying apparatus for a mailing machine in which there is a control means to cause the cleaning device and the ink drying device to operate on the nozzle plate and the envelopes in timed coordination with the movement of the envelopes along a feed deck extending through the mailing machine so that the cleaning device operates between successive envelopes and the ink drying device operates on each successive envelope.

These and other objects and advantages of the present invention will be more apparent from an understanding of the following detailed description of presently preferred modes of carrying out the invention, when considered in conjunction with the accompanying drawings.

DETAILED DESCRIPTION OF THE INVENTION

Figure 1:
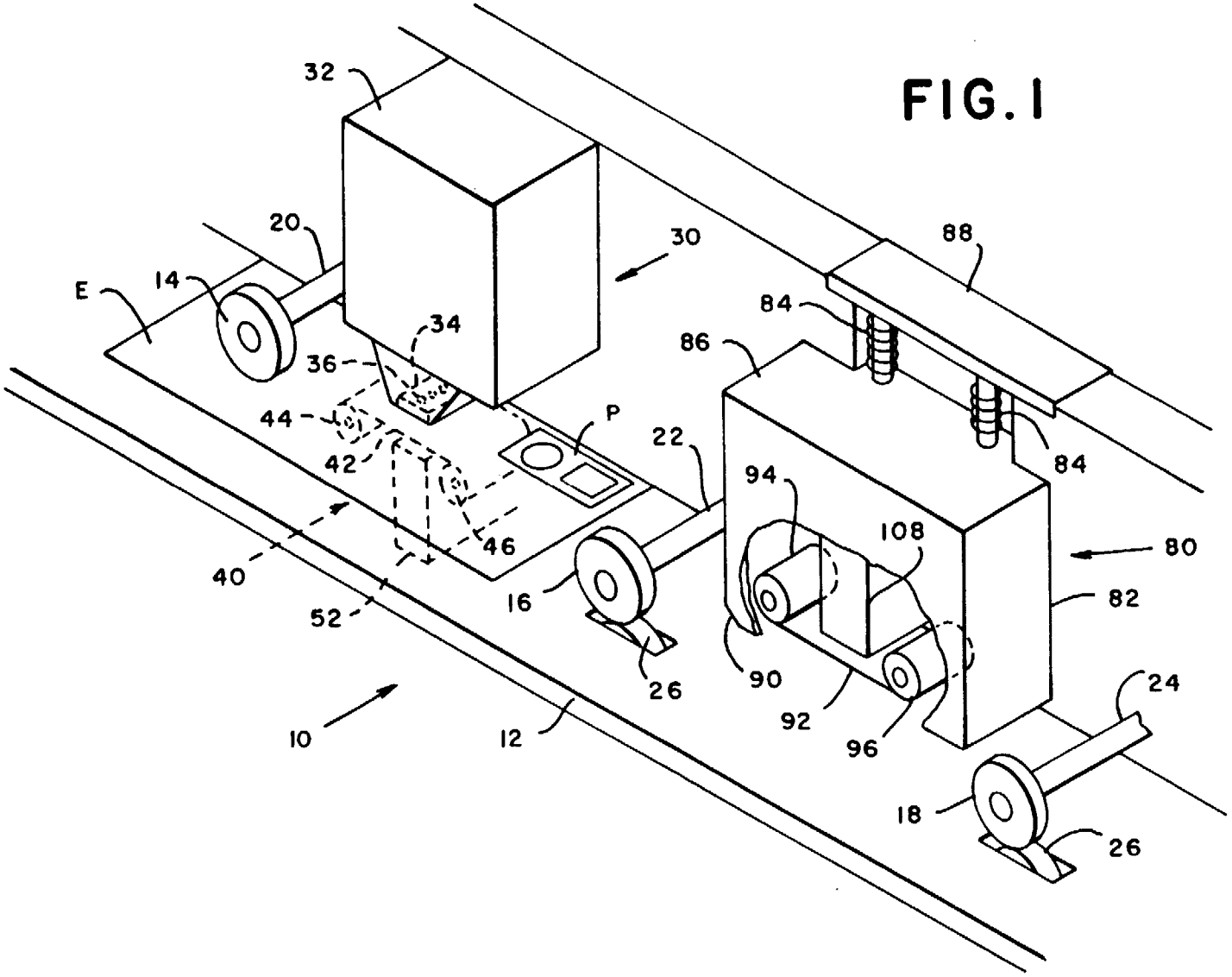
FIG. 1 is a perspective view of a representative mailing machine incorporating the principles of the present invention.

Referring now to the drawings, and particularly to FIG. 1 thereof, the principles of the present invention are shown embodied in a representative mailing machine, indicated generally by the reference numeral 10, of which there are many designs in the literature and commercially available, most of the details of which are not pertinent to a full understanding of the present invention. It is only necessary to understand, for the purposes of the present invention, that a typical mailing machine includes a feed deck along which envelopes are fed, a feeding means for feeding envelopes seriatim along the feed deck, and a postage meter which includes a printing device for printing a postage indicia on the envelopes as they either pass through or momentarily stop at a printing location in the mailing machine, depending on whether the printing device is an ink transfer printer of the rotary or flat bed type, or is a digital printer, such as an ink jet printer which can print on either moving or stationary envelopes. The postage meter typically includes either mechanical or electronic means for selectively setting printing elements so that the postage indicia includes a mailing date and the proper amount of postage depending on the weight of the envelope and its contents.

Thus, the representative mailing machine 10 which embodies the principles of the present invention includes a feed deck 12 along which envelopes E are adapted to be fed to have a postage indicia P printed thereon. The mailing machine 10 also includes any suitable form of envelope feeding device, which in the illustrative machine shown in the drawings is indicated by the three feed rollers 14, 16 and 18, driven by shafts 20, 22 and 24, each feed roller cooperating in driving engagement with a plurality of suitable back up pressure rollers 26 through openings 28 (FIG. 2) formed in the feed deck 12.

Figure 2:
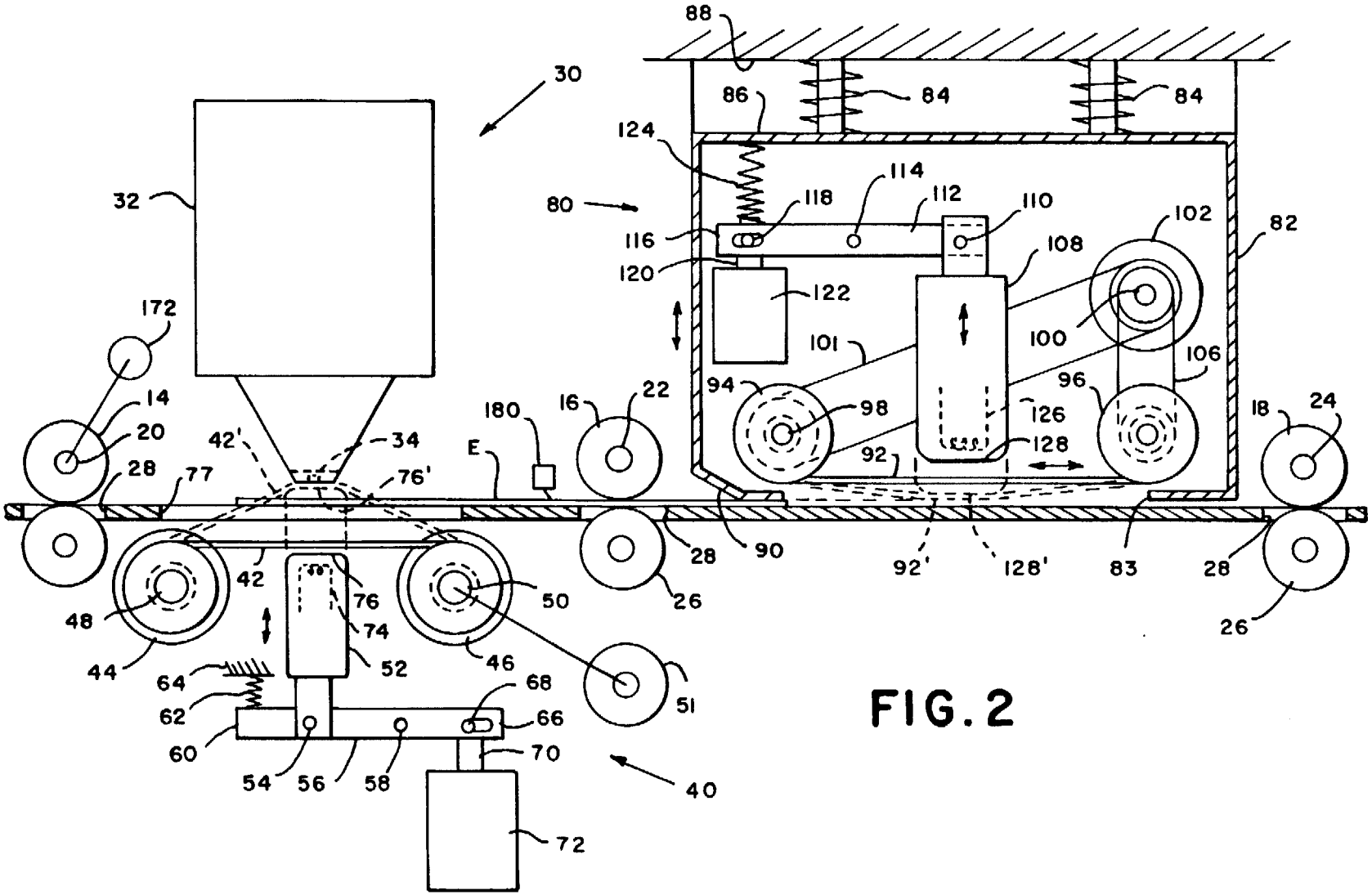
FIG. 2 is a side view, partly in section, of the mailing machine shown in FIG. 1.

With reference to FIGS. 1 and 2, the mailing machine 10 include a postage meter having an ink jet printing device, indicated generally by the reference numeral 30. Since ink jet printing devices are well known in the art in a variety of forms, the details of construction thereof are not further described, except as noted below, since they are not germane to the present invention. The printing device 30 includes a housing 32, a nozzle plate 34 suitably mounted on the lower end of the housing 32, and a plurality of individual nozzles 36 formed in the nozzle plate 34. The construction and arrangement of the printing device 30 is such that the nozzle plate 34 is disposed in closely spaced relationship with the upper surface of the envelope E so that ink ejected from the nozzles 36 will be deposited on the upper surface of the envelope as it is fed past the printing device 30 by the feed rollers 14 and 16.

As best seen in FIG. 2, one of the novel aspects of the present invention is illustrated in the form of the nozzle plate cleaning device, indicated generally by the reference numeral 40. The cleaning device 40 is suitably mounted on a portion of the frame or the mailing machine on the opposite side of the feed deck 12 from the printing device 30, and includes a supply of ink absorbent material 42 in the form of an elongate strip that is mounted on a supply reel 44 and drawn to a take up reel 46, both of which are individually mounted in the mailing machine on shafts 48 and 50 respectively. The take up reel 46 is driven by the drive shaft 50 which is connected to a motor 51 for rotating the shaft 50 to move the strip of material 42 from left to right. It will be apparent that the motor 51 can also be adapted to drive the shaft 48 in a reverse direction from that of the shaft 50 if it is desired to be able to rewind the strip of absorbent material 42 from the take up reel 46 back to supply reel 44 for reuse.

A housing 52 is suitably mounted beneath the strip of material 42 for vertical movement between the lower position shown in solid lines in FIG. 2 and the upper position shown in dotted lines. The lower end of the housing 52 is pivotally connected as at 54 to a rocking lever 56, which in turn is pivotally connected as at 58 to the supporting frame for the cleaning device 40, and one end 60 of the lever 56 is biased downwardly by a compression spring 62 captured between the end 60 of the lever 56 and a portion 64 of the supporting frame. The other end 66 of the lever 56 is pivotally connected as at 68 to the upper end of the plunger 70 of a solenoid 72. A heating element 74 is suitably mounted in the housing 52 adjacent the upper surface 76 thereof.

From the foregoing, it will be seen that when the solenoid 72 is actuated, the plunger 70 is pulled downwardly, which pivots the lever 56 about the pivot point 58 to move the other end 60 of the lever 56 upwardly against the bias of the spring 62, which in turn moves the housing 52 upwardly toward the strip of absorbent material 42. The housing 52 moves upwardly far enough to bring the upper surface 76 thereof to the position indicated as 76' so as to move the strip of material 42 upwardly through an opening 77 in the feed deck 12 to the position indicated as 42' where the upper surface thereof contacts the lower surface of the nozzle plate 34. Simultaneously, the heating element 74 is energized and the shaft 50 is rotated by the motor 51 to move the strip of material 42 a predetermined increment to clean the nozzle plate 34. It is apparent, of course, that this sequence of events can only take place when there is no envelope E on the feed deck obstructing the opening 77.

The other novel aspect of the present invention is illustrated in FIG. 2 in the form of an ink drying device, indicated generally by the reference numeral 80. In the illustrated embodiment, the ink drying device 80 is suitably mounted in the mailing machine 10 in downstream spaced relationship with the ink jet printing device 30 and on the same side of the feed deck as the printing device 30. The drying device comprises a housing 82 which is suitably mounted in the frame of the mailing machine for limited vertical movement, and which is biased downwardly by compression springs 84 captured between an upper wall 86 of the housing 82 and a portion 88 of the mailing machine frame. The lower portion of the housing 82 includes an opening 83, and on the upstream side thereof is provided with a suitable camming surface 90 so as to raise the housing 82 to accommodate envelopes of different thickness.

The ink drying device 80 is quite similar in construction and function to the ink jet nozzle plate cleaning device 40, and further includes a supply of ink absorbent material 92 in the form of an elongate strip that is mounted on a supply reel 94 and drawn to a take up reel 96, both of which are individually mounted in the mailing machine on shafts 98 and 100 respectively that are individually mounted in the housing 82. The reels 94 and 96 are suitably driven by the shafts 98 and 100 respectively which are connected to a motor 102 by belts 104 and 106 respectively for rotating the shafts 98 or 100 depending on which direction the strip of material 92 is to be fed. As with the previously described embodiment, it will be apparent that the motor 102 can also be adapted to drive the shafts 98 and 100 in a reverse direction if it is desired to be able to rewind the strip of absorbent material 92 from the take up reel 96 back to supply reel 94 for reuse.

A housing 108 is suitably mounted in the housing 82 above the strip of material 92 for vertical movement between the upper position shown in solid lines in FIG. 2 and the lower position shown in dotted lines. The upper end of the housing 108 is pivotally connected as at 110 to one end a rocking lever 112, which in turn is pivotally connected as at 114 to the rear wall of the housing 92, and the other end 116 of the lever 112 is pivotally connected as at 118 to the upper end of the plunger 120 of a solenoid 122. A tension spring 124 is captured between the upper end of the plunger 120 and the upper wall 86 of the housing 82 to bias the plunger 120 and the adjacent end of the lever 112 downwardly A heating element 126 is suitable mounted in the housing 108 adjacent the lower end 128 thereof.

From the foregoing, it will be seen that when the solenoid 122 is actuated, the plunger 120 is pushed upwardly, which pivots the lever 112 about the pivot point 114 to move the other end of the lever 112 downwardly against the bias of the spring 124, which in turn moves the housing 108 downwardly toward the strip of absorbent material 92. The housing 108 moves downwardly far enough to bring the lower surface 128 thereof to the position indicated as 128' so as to move the strip of material 92 downwardly through the opening 83 in the housing 82 to the position indicated as 92' where the lower surface thereof contacts the upper surface of the envelope E. Simultaneously, the heater 126 is energized and the shaft 100 is rotated by the motor 102 to move the strip of material 92 a predetermined increment in synchronism with the movement of the envelope E so as to press it against the indicia P and absorb any ink that has not dried.

Figure 3:
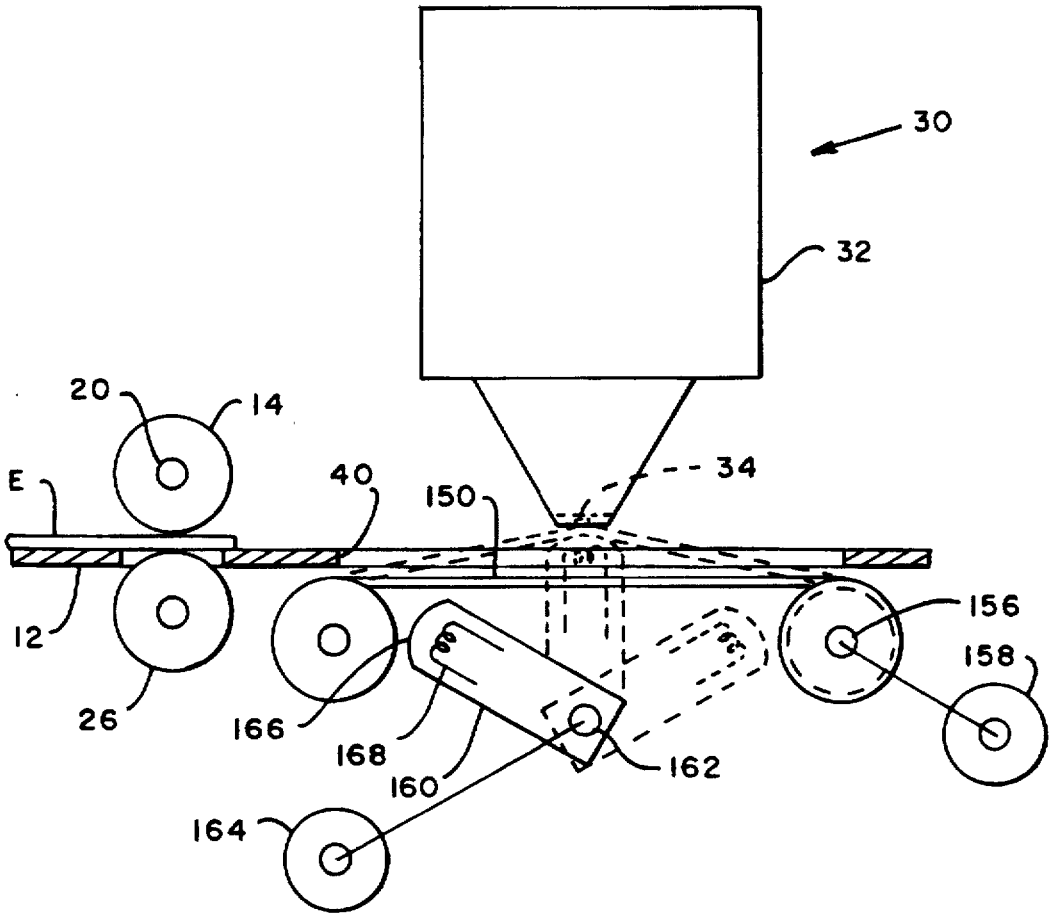
FIG. 3 is a side view, partly in section, of a modified form of the invention shown in FIGS. 1 and 2.
Figure 4:
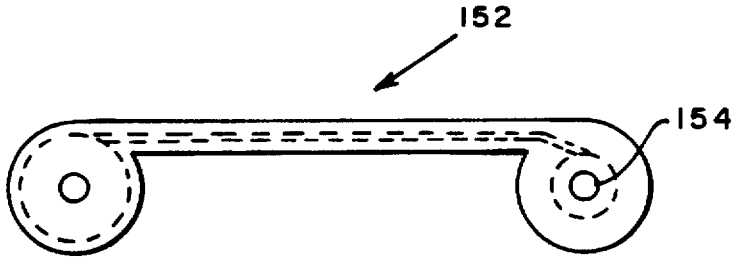
FIG. 4 is side view of a modified form of storing the ink absorbent material.

FIG. 3 illustrates another embodiment of the invention described above in which the vertically movable housings 52 and/or 108 are replaced with similar housings which are mounted for either oscillatory or rotary movement which is synchronized with the movement of the strips of absorbent material 42 or 92 respectively. Thus, as seen in FIG. 3, where like parts as seen in FIG. 2 are indicated with the same reference numerals, the printing device 30 is mounted over the feed deck 12 adjacent the opening 40 therein, and feed roller pairs 14, 16 and 18 feed an envelopes E along the feed deck. One modification of the embodiment shown in FIGS. 1 and 2 is that the strip of absorbent material 150 is housed in a suitable cassette, indicated generally by the numeral 152 in FIG. 4. Such cassettes are well known in the art and further description thereof is not deemed necessary to an understanding of the invention, other than to note that the cassette is provided with an internal spindle 154 which fits over a suitable drive shaft 156 which is driven by a motor 158 in the same manner as the shaft 50 for the reel 46 in the embodiment shown in FIG. 2. The advantage of the cassette arrangement for housing the absorbent material 150 is that the combination of both elements constitutes a disposable unit which is easier to install into and remove from the mailing machine, and is more convenient to handle and dispose of than the separate reels 44/46 and 94/96 in the embodiment illustrated in FIG. 2.

An additional modification of this embodiment is that the housing for the heating element moves with the strip of absorbent material 150 so that there is no relative motion between the housing and the absorbent material 150 either when the absorbent material is cleaning the nozzle plate 34 of the printing device 30 or is in contact with a freshly printed postage indicia P to absorb wet ink. Thus, it will be seen in FIG. 3 that a housing 160 is suitably mounted on the free end of a shaft 162 which is suitably connected to a motor 164. The housing 160 is provided with a curved end wall 166 which has a radius of curvature equal to or less than the radius of curvature of the arc traversed by the center point of the end wall 166 as the housing 160 rotates so that there is substantially only line contact between the absorbent material 150 and the underside of the nozzle plate 34 as the end wall 166 moves between the solid line position and the dotted line positions shown in FIG. 3. A heating element 168 is mounted within the housing 160 adjacent the end wall 166 in the same manner, and for the same function, as shown and described for the embodiment of FIG. 2.

It should be apparent that several modes of operation of this embodiment of the invention are contemplated within the invention. One mode is that the housing 160 rotates in a clockwise direction at an angular velocity that will cause the end wall to have a peripheral velocity that is equal to the linear velocity of the strip of absorbent material 150. Another mode is that the housing 160 oscillates, first rotating in a clockwise direction as just described to either wipe the nozzle plate 34 of the printing device 30 or to dry the ink on a freshly printed indicia P, and upon completion of either of these functions, rotate in the reverse direction back to the starting position while the absorbent material 150 is stationary. A still further mode is that more than one housing 160 can be mounted on the shaft 162, which is rotated only in a clockwise direction, with the result that a plurality of wiping or drying actions are obtained with each complete revolution of the shaft 162, depending on the number of housings 160 that are mounted on the shaft 162. It will, of course, be understood that the same rotary drive arrangement as just described for the ink jet printer nozzle plate 34 can be substitute for the solenoid actuated drive of the ink drying component 80 shown in FIG. 2, and further description of this substitution is not deemed necessary for a full understanding of the present invention.

Figure 5:
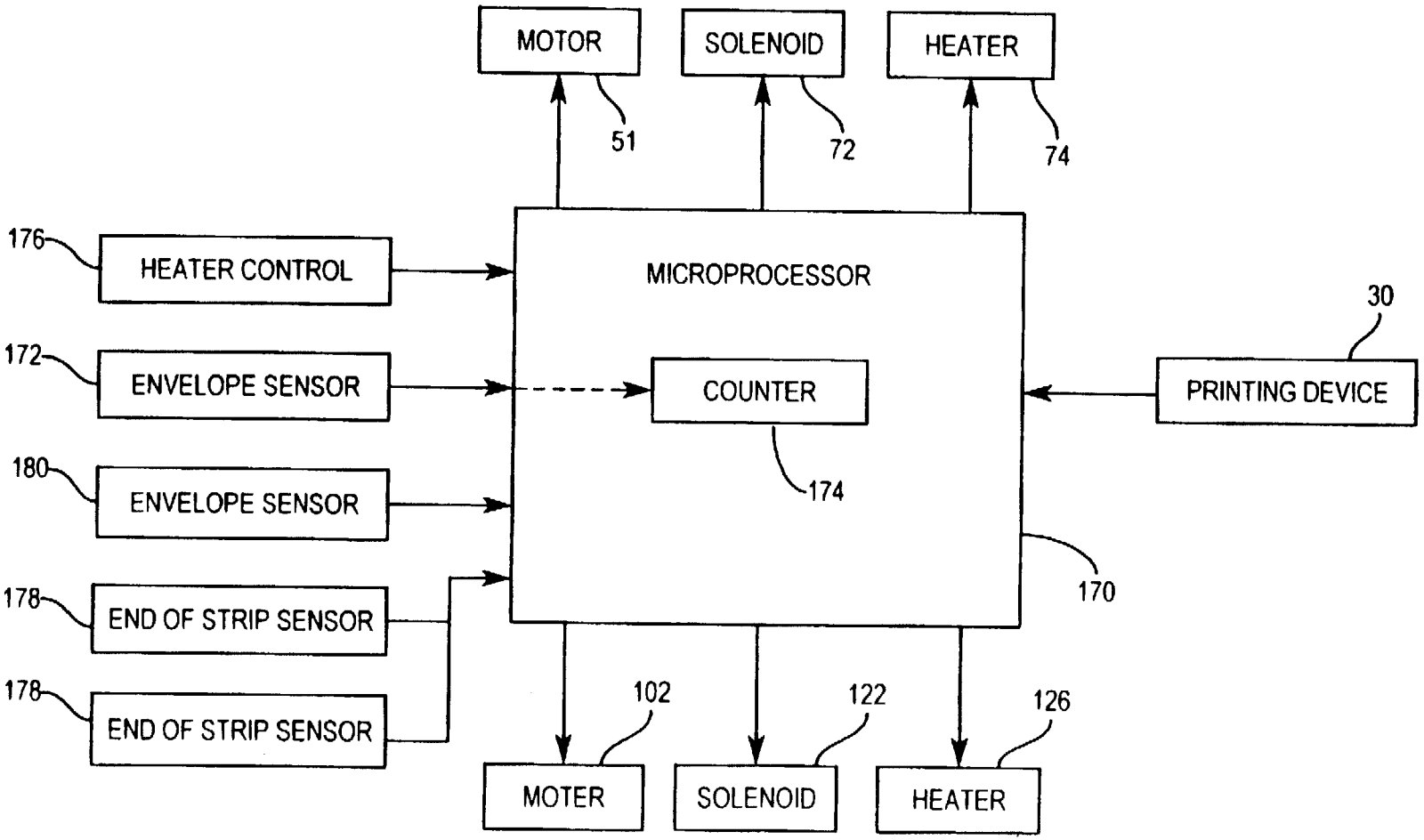
FIG. 5 is a schematic diagram of an operating control system for the apparatus of the present invention.

FIG. 5 illustrates a schematic of the principle elements of a representative control system for the apparatus of the present invention. The control system includes a microprocessor 170 which, in a manner known in the art, controls the operation of the envelope feeding means, the absorbent material driving means and heating element positioning means described above. Thus, the components of the control system for controlling the operation of the nozzle plate cleaning device 40 include an envelope spacing sensor 172, which may be an optical encoder or known design (shown schematically in FIG. 2) connected to the drive for the feed rollers 14, or other suitable device for sensing the movement and passage of successive envelopes past the printing device 30, that provides a signal to the microprocessor 170 that an envelope E is in a predetermined position so that the microprocessor can synchronize the operation of the nozzle plate cleaning device 40, either with the spacing between successive envelopes, or periodically after a predetermined number of envelopes have passed the printing device, as controlled by a suitable counter 174 within the microprocessor 170. The printing device 30 provides a signal to the microprocessor 170 which is indicative of the status of any given printing operation to synchronize a cleaning operation with the movement of a particular envelope, as determined by the counter 174, so that a cleaning operation cannot be commenced before completion of the printing operation which precedes the cleaning operation. When the counter 174 determines that it is time to clean the nozzle plate 34, the microprocessor energizes the motor 51 to drive the reel 46 and move a small increment of the absorbent material 42 in a forward direction of movement, i.e., from left to right as viewed in FIG. 2. Simultaneously, the microprocessor 170 energizes the solenoid 72 to raise the upper surface 76 of the housing 52 to the dotted line position 76', thereby raising the absorbent material 42 to the dotted line position 42' so that it contacts the lower surface of the nozzle plate 34. The microprocessor 170 also energizes the heating element briefly to heat portion of the absorbent material 42 that is in contact with the nozzle plate 34 while it is moving. The amount of heat imparted to the absorbent material 42 from the heating element 74 is controlled by a suitable electrical control device 176. In actual practice, each operation of the cleaning device 40 requires only about one inch of absorbent material to be fed past the nozzle plate, and each cleaning operation can be fully accomplished in about 10 seconds. When the cleaning operation is completed, the microprocessor 170 causes the operating elements to return to their static positions as shown in FIG. 2.

An end of strip sensor 178 may also be provided and connected to the microprocessor 170 so as to cause it to energize the motor 51 in a reverse direction to cause the reel 44 to rewind the absorbent material 42 from the take up reel 46 back to the supply reel 44 for reuse, assuming that appropriate connections between the motor 511 and the shaft 48 have been provided for driving the reel 44 in this direction.

The components of the control system for controlling the operation of the ink driving device 80 are similar in function to those described above, and include a suitable sensor for determining when the lead edge of an envelope is at a predetermined location slightly upstream from the ink drying device 80, which can be merely an envelope trigger switch 180 located on the feed deck 12 adjacent to the feed roller 16 which in the same manner as the envelope sensor 172, causes the microprocessor 170 to synchronize the operation of the ink drying device 80 with the movement of the portion of the envelope E that includes the postage indicia P under the opening 83 in the housing 82. Thus, when the trigger switch 180 sensed the lead edge of an envelope E, it causes the microprocessor 170 to energize the motor 102 to drive the reel 96 and move a small increment of absorbent material 92 in a forward direction, again from left to right as viewed in FIG. 2. It is essential, of course, that the linear velocity of the absorbent material 92 be precisely the same as the linear velocity of the envelope E since the absorbent material 92 will be in contact with the surface of the envelope E during the ink drying operation. Simultaneously, the microprocessor 170 energizes the solenoid 122 to lower the lower surface 128 of the housing 108 to the dotted line position 128', thereby lowering the absorbent 92 to the dotted line position 92' so that it contacts the postage indicia P on the upper surface of the envelope. The microprocessor 170 also energizes the heating element 126 to heat the portion of the absorbent material 92 that is in contact with the postage indicia and/or other printed material such as an advertising slogan.

During the time that the absorbent material 92 is in contact with the postage indicia P, the heat from the heating element 126 causes the ink to permeate the fibers of the paper more effectively than if the ink were allowed to dry at ambient temperature, and also causes the volatile solvents in the ink to evaporate more quickly, thereby increasing the speed at which the ink dries. Any remaining ink that does not permeate the paper thoroughly or dry on the surface will be absorbed by the absorbent material 92. Again, when the ink drying operation is completed, the microprocessor 170 causes the operating elements to return to their static positions as shown in FIG. 2.

It will apparent from the foregoing description that if the angular drive arrangement shown in FIG. 3 for the housing 160 is utilized either in the nozzle plate cleaning device 40 or the ink drying device 80, the only change that is required in the control system is that a motor 164 be substituted either for the solenoid 72 or the solenoid 122, or both. In this event, the microprocessor would control the operation of the motor 164 in such a manner as to cause it to drive the housing 160 through any of the forms of rotary motion described hereinabove. Again, it will be apparent that the movement of the housing 160 must be synchronized with the movement of the envelope so it occurs between successive envelopes, or after any predetermined number, in the case of the printing device 30, and when the postage indicia P on every envelope is under the opening 83 in the housing 82.

It is to be understood that the present invention is not to be considered as limited to the specific embodiments described above and shown in the accompanying drawings, which are merely illustrative of the best modes presently contemplated for carrying out the invention and which are susceptible to such changes as may be obvious to one skilled in the art, but rather that the invention is intended to cover all such variations, modifications and equivalents thereof as may be deemed to be within the scope of the claims appended hereto.

I claim:

1. A mailing machine comprising: a feed deck along which envelopes are adapted to be fed seriatim for having a postage indicia printed thereon; feeding means for feeding the envelopes along said feed deck; an ink jet print head disposed in overlying relationship to said feed deck for printing on envelopes moving therealong, said print head including a nozzle plate disposed closely adjacent to the feed deck; means for periodically ejecting ink through apertures in said nozzle plate; and a print head cleaning and ink drying apparatus including A. cleaning means disposed adjacent said print head in spaced relationship with said nozzle plate but on the opposite side of said feed deck from said print head for periodically cleaning said nozzle plate, B. drying means disposed adjacent said print head in spaced relationship with said feed deck but on the same side of said feed deck as said print head for drying the ink on said envelopes as said envelopes are moved along said feed deck beyond said print head, and C. control means for coordinating the operation of said cleaning means and said drying means with the movement of said envelopes along said feed deck to cause said cleaning means to clean said nozzle plate after each or a predetermined plurality of envelopes have moved along said feed deck and past said print head, and to cause said drying means to dry the ink on said envelopes after each printing operation as each envelope passes along said feed deck under said drying means, wherein said drying means comprises A. a first ink absorbent material disposed in spaced relationship with said feed deck, B. first moving means for moving said first ink absorbent material toward and away from said feed deck to bring said first ink absorbent material into contact with the upper surface of a portion of said envelopes while said envelopes are moving across said feed deck, and C. second moving means for moving said first ink absorbent material relative to said feed deck in the direction of movement of said envelopes while said first ink absorbent material is in contact with said envelopes so that said first ink absorbent material moves with said portion of said upper surface of said envelopes.

2. A mailing machine as set forth in claim 1 wherein said cleaning means comprises A. a second ink absorbent material disposed in spaced relationship with said nozzle plate, B. third moving means for moving said second ink absorbent material toward and away from said nozzle plate to bring said second ink absorbent material into contact with said nozzle plate, and C. fourth moving means for moving said second ink absorbent material relative to said nozzle plate in the direction of movement of said envelopes while said second ink absorbent material is in contact with said nozzle plate so that said second ink absorbent material wipes across said nozzle plate.

3. A mailing machine as set forth in claim 2 wherein said control means includes means for coordinating the operation of said third moving means with the movement of said envelopes along said feed deck so that said third moving means operates to move said second ink absorbent material into contact with said nozzle plate after said print head has printed on each or a predetermined number of successive envelopes moving along said feed deck.

4. A mailing machine as set forth in claim 3 wherein said cleaning means further comprises a second heating element mounted on a portion of said third moving means adjacent to said second ink absorbent material so that said second ink absorbent material is heated in the area where said second ink absorbent material contacts said nozzle plate.

5. A mailing machine as set forth in claim 4 wherein said third moving means includes means for moving said second heating element and said adjacent area of said second ink absorbent material in a linear direction perpendicular to the direction of movement of said second ink absorbent material caused by said fourth moving means whereby said second heating element remains stationary relative to said nozzle plate while said fourth moving means causes said second ink absorbent material to move relative to said nozzle plate.

6. A mailing machine as set forth in claim 4 wherein said third moving means includes means for moving said second heating element in an arcuate path both toward and away from said nozzle plate and in the same direction of movement of said second ink absorbent material caused by said fourth moving means whereby said second heating element remains stationary relative to said second ink absorbent material and moves therewith in said arcuate path while said second ink absorbent material moves across said nozzle plate.

7. A mailing machine as set forth in claim 4 wherein

A. said second ink absorbent material is in the form of a strip of said material of indefinite length, of which a supply thereof is stored in said cleaning apparatus, and B. said means for moving said second ink absorbent material relative to said nozzle plate comprises means for pulling a predetermined length of said strip from said supply thereof.

8. A mailing machine as set forth in claim 4 wherein

A. said second ink absorbent material is contained in a cassette including a supply spool and a take up spool, and B. said means for pulling said second ink absorbent material from said supply comprises means for driving said take up spool.

9. A mailing machine as set forth in claim 1 wherein said control means includes means for coordinating the operation of said first moving means with the movement of said envelopes along said feed deck so that said first moving means operates to move said first ink absorbent material into contact with said envelopes while the printed area on each successive envelope is moving past said drying means.

10. A mailing machine as set forth in claim 9 wherein said drying means further comprises a first heating element mounted on said first moving means adjacent to said first ink absorbent material so that said first ink absorbent material is heated in the area where said first ink absorbent material contacts said portion of said upper surface of said envelope.

11. A mailing machine as set forth in claim 10 wherein said first moving means includes means for moving said first heating element and said adjacent area of said first ink absorbent material in a linear direction perpendicular to the direction of movement of said first ink absorbent material caused by said second moving means whereby said first heating element remains stationary relative to said envelope while said second moving means causes said first ink absorbent material to move relative to said nozzle plate.

12. A mailing machine as set forth in claim 10 wherein said first moving means includes means for moving said first heating element and said adjacent area of said first ink absorbent material in an arcuate path both toward and away from said envelope and in the same direction of movement of said first ink absorbent material caused by said second moving mean whereby said first heating element is stationary relative to said first ink absorbent material and moves therewith in said arcuate path while said first ink absorbent material moves across said envelope.

* * * * *